US007481665B2

(12) United States Patent
Hiramatsu

(10) Patent No.: US 7,481,665 B2
(45) Date of Patent: Jan. 27, 2009

(54) CONNECTOR

(75) Inventor: Hiroyuki Hiramatsu, Yokkaichi (JP)

(73) Assignee: Sumitomo Wiring Systems, Ltd (JP)

( * ) Notice: Subject to any disclaimer, the term of this patent is extended or adjusted under 35 U.S.C. 154(b) by 0 days.

(21) Appl. No.: 11/975,540

(22) Filed: Oct. 19, 2007

(65) Prior Publication Data

US 2008/0096414 A1 Apr. 24, 2008

(30) Foreign Application Priority Data

Oct. 24, 2006 (JP) ..... 2006-288447

(51) Int. Cl.
*H01R 4/38* (2006.01)

(52) U.S. Cl. ..... 439/385; 439/352; 439/371

(58) Field of Classification Search ..... 439/385, 439/371, 345, 352, 382, 383
See application file for complete search history.

(56) References Cited

U.S. PATENT DOCUMENTS 5,529,512 A * 6/1996 Mlyniec ..... 439/352
5,637,010 A * 6/1997 Jost et al. ..... 439/352
5,688,141 A * 11/1997 Dullin ..... 439/352
5,688,142 A * 11/1997 Dietz et al. ..... 439/489
5,718,596 A * 2/1998 Inaba et al. ..... 439/352
5,746,619 A * 5/1998 Harting et al. ..... 439/352
6,685,496 B2 2/2004 Ookura
6,843,677 B2 * 1/2005 Fukuda ..... 439/374
7,104,831 B2 * 9/2006 Fukatsu et al. ..... 439/385
7,311,546 B2 * 12/2007 Itou ..... 439/385

* cited by examiner

*Primary Examiner*—Hien Vu
(74) *Attorney, Agent, or Firm*—Gerald E. Hespos; Anthony J. Casella

(57) ABSTRACT

A connector has a male housing (10) with a hood (12) and a female housing (20) that can be telescoped into the hood (12). The female housing (20) has an elastic hold-down piece (38) that elastically contacts the male housing (10) at an angle to a direction in which the housings (10; 20) are telescoped together. An elastic pressing force of the elastic hold-down piece (38) prevents housings (10) and (20) from shaking at an angle to the fit-in direction. The elastic hold-down piece (38) is made of the synthetic resin and has a small elastic deformation amount. Thus, the elastic hold-down piece (38) has a higher effect than an elastic hold-down piece made of rubber in preventing shaking.

6 Claims, 8 Drawing Sheets

CONNECTOR

BACKGROUND OF THE INVENTION

1. Field of the Invention

The invention relates to a connector.

2. Description of the Related Art

A connector used near the engine of a car is subjected to vibration, and shaking occurs between a male housing and a female housing in a direction approximately perpendicular to the direction in which the male and female housings fit together. There is a fear that the shaking causes a slight sliding-contact wear to be generated between terminal fittings inside both housings.

U.S. Pat. No. 6,685,496 uses a seal of the connector to overcome the generation of the slight sliding-contact wear. More particularly, a rubber seal ring is mounted on the periphery of the female housing and closely contacts the inner periphery of the hood of the male housing when both housings have been fit together. U.S. Pat. No. 6,685,496 explains that the seal ring prevents shaking between the male and female housings in a direction perpendicular to the direction in which the housings are fit together. However, the above-described seal ring is made of rubber and is elastically deformable. Thus, the seal ring cannot prevent shaking.

The invention has been completed in view of the above-described situation. Therefore it is an object of the invention to prevent male and female housings from shaking in a direction perpendicular to a direction in which the male housing and the female housing are fit together.

SUMMARY OF THE INVENTION

The invention relates to a connector including a male housing and a female housing, each of which is made of synthetic resin. The male housing has a hood, and the female housing can be fit in the hood. The male housing and/or the female housing has an elastic hold-down piece that contacts the mating housing perpendicularly or approximately perpendicularly to a direction in which the male and the female housing are fit together.

A retainer fits in the housing and is disposed to prevent the elastic hold-down piece from being displaced in a direction to escape from the mating housing.

A rubber seal ring is mounted between peripheral surfaces of the male and female housings when the housings are fit together. The elastic hold-down piece is disposed so that the mating housing is sandwiched radially between the elastic hold-down piece and the seal ring.

The elastic pressing force of the elastic hold-down piece prevents the housings from shaking in directions angularly aligned to the fit-in direction when the housings have been fit together. The elastic hold-down piece is made of the synthetic resin and has an elastic deformation amount less than an elastic hold-down piece made of rubber. Thus, the elastic hold-down piece is more effective at preventing the housings from shaking than an elastic hold-down piece made of rubber.

The retainer prevents the elastic hold-down piece from being displaced away from the mating housing. Thus the elastic hold-down piece securely displays its hold-down function.

The elastic pressing force of the elastic hold-down piece is imparted to the seal ring through the mating housing. Therefore the seal ring has an improved sealing performance.

DETAILED DESCRIPTION OF THE PREFERRED EMBODIMENTS

Figure 1:
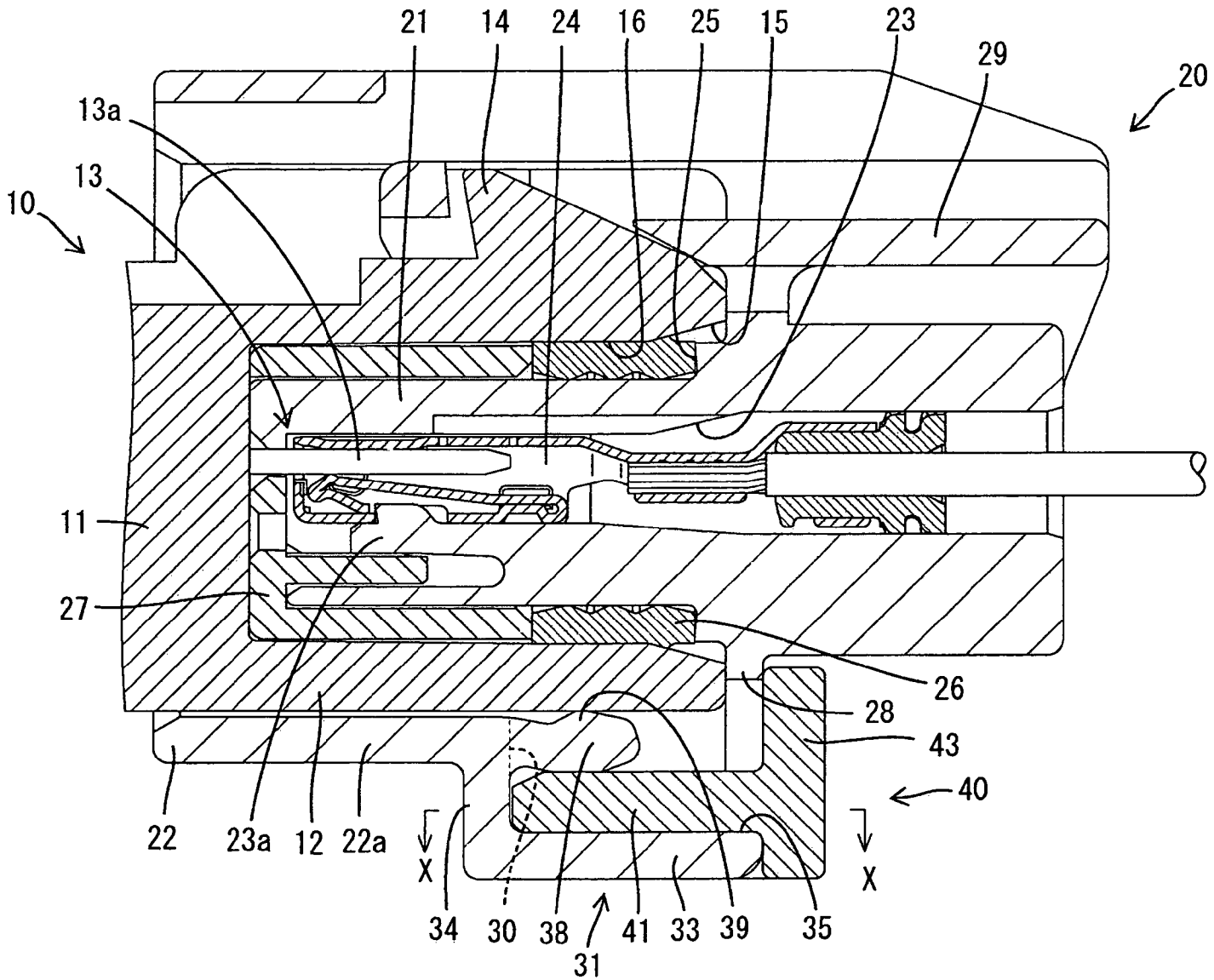
FIG. 1 is a sectional view showing a state in which a male housing and a female housing are fit together in the first embodiment.
Figure 2:
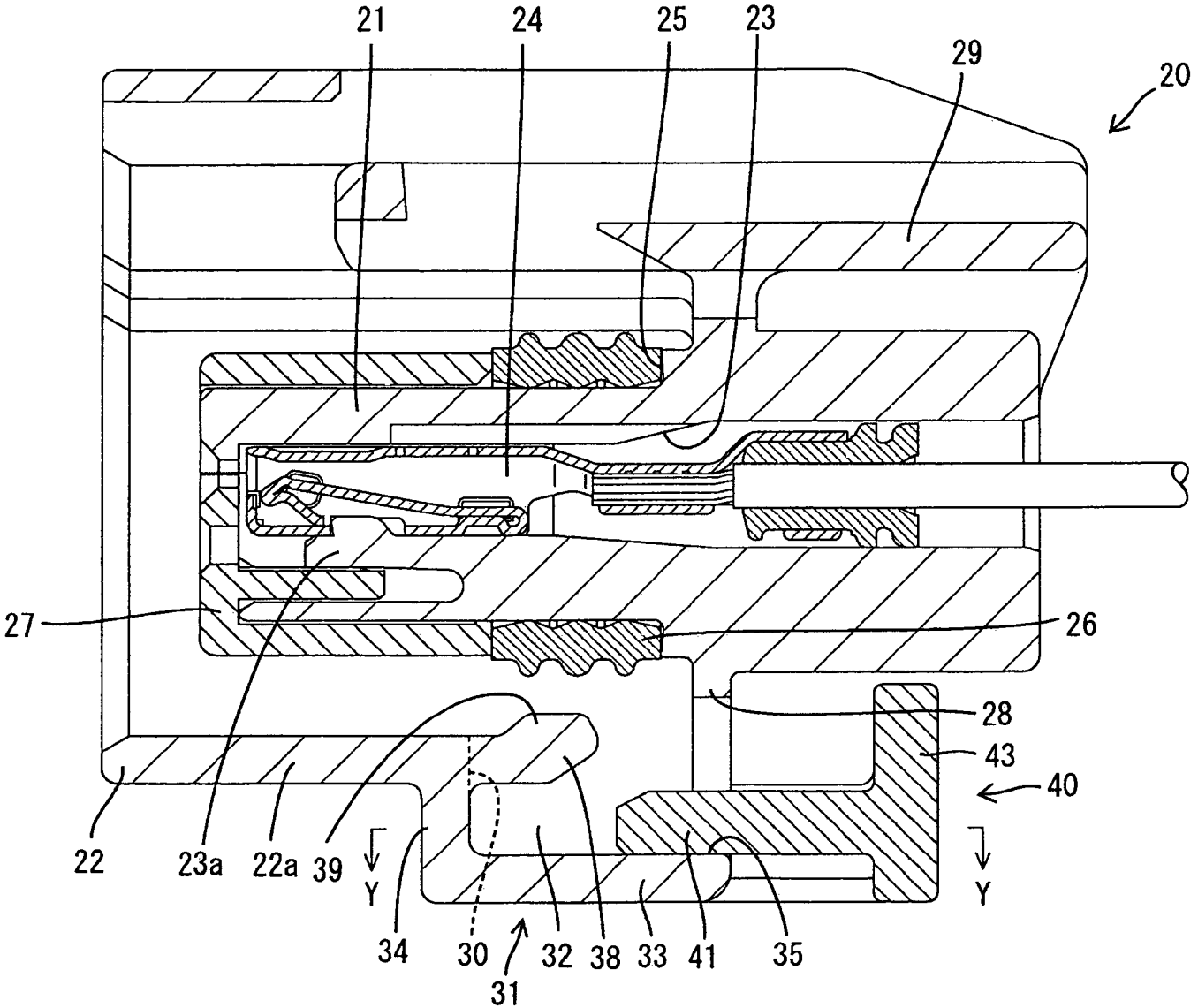
FIG. 2 is a sectional view showing a state in which a seal ring, a holder, a retainer, and female terminal fittings are mounted on the female housing.
Figure 3:
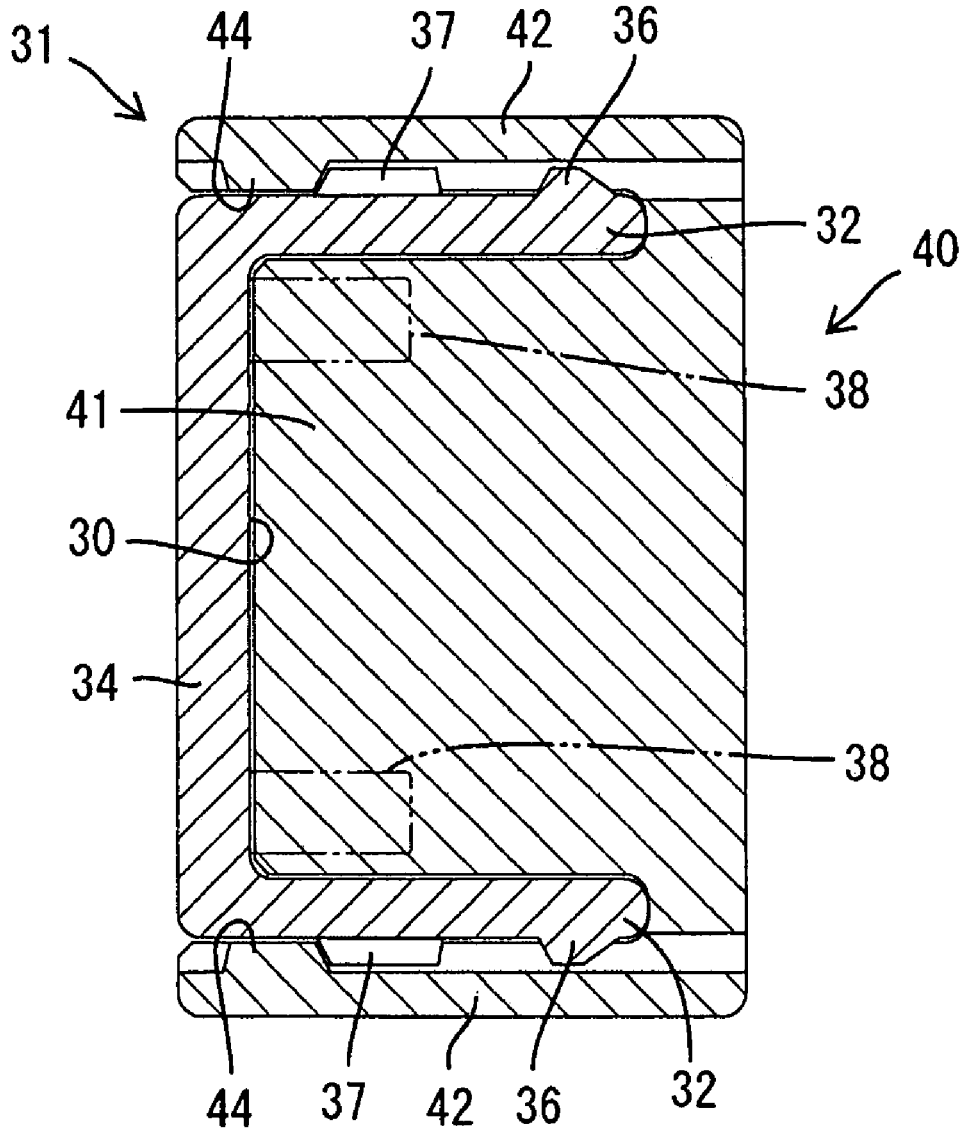
FIG. 3 is a sectional view along a line X-X of FIG. 1.

A connector in accordance with the invention includes a male housing identified by the numeral 10 in FIGS. 1 and 2. The male housing 10 is made of synthetic resin and has a housing body 11 for holding male terminal fittings 13. A hood 12 projects forward from the housing 11 and is formed integrally with the housing 11. A long and narrow tab 13*a* is insert molded in the housing body 11 or is press-fit in the housing body 11 and projects from a front-end surface of the housing body 11. Thus, the housing body 11 is surrounded by the hood 12. The hood 12 is oblong in a front view and a locking projection 14 is formed on an outer surface of an upper wall of the hood 12. The entire inner peripheral surface of a front end of the hood 12 is cut out along an edge of an opening of the hood part 12 to form a guide surface 15. A sealing surface 16 is formed on an inner peripheral surface of the front end of the hood 12 adjacent to a rear side of the guide surface 15.

The connector also includes a female housing 20 made of synthetic resin. The female housing 20 is composed of an oblong block-shaped terminal fitting accommodation part 21 and an approximately oblong tubular fit-in part 22 formed unitarily with the terminal fitting accommodation part 21.

Cavities 23 penetrate the terminal fitting accommodation part 21 longitudinally and are arranged side by side in the width direction of the female housing 20. A lance 23*a* cantilevers forward along a lower wall of each cavity 23. Female terminal fittings 24 are inserted respectively into the cavities 23 from the rear and are locked by the lance 23*a*. A stopper 25 is formed at approximately the longitudinal center each cavity 23 and are continuous with the entire periphery of the terminal fitting accommodation part 21. A region of the terminal fitting accommodation part 21 forward from the stopper 25 is smaller than a region rearward from the stopper 25. A rubber seal ring 26 is fit on the periphery of the terminal fitting accommodation part 21 from the front thereof and contacts the stopper 25. Thus, the seal ring 26 is prevented from moving rearward. A cylindrical holder 27 is fit on the terminal fitting accommodation part 21 from the front to preventing the seal ring 26 from being removed forward.

A coupling 28 extends from the rear end of the tubular fit-in part 22 to the periphery of the terminal fitting accommodation part 21 to support the tubular fit-in part 22 relative to the terminal fitting accommodation part 21. The tubular fit-in part 22 surrounds approximately the front-half of the terminal fitting accommodation part 21, including the seal ring 26 and the holder 27 forward of the stopper 25. A cut out is formed on upper surface of the tubular fit-in part 22 and a locking arm 29 is disposed in the cut-out. The locking arm 29 is supported by the terminal fitting accommodation part 21 at the coupling 28 and is vertically elastic like a seesaw on the coupling 28. The left and right halves of the tubular fit-in part 22 are symmetrical with respect to a vertical center line. Similarly, the left and right halves of the locking arm 29 are symmetrical with respect to a vertical center line.

The tubular fit-in part 22 has a lower wall 22*a* and an approximately square cut-out 30 extends forward from the rear end of the lower wall 22*a*. A receiving portion 31 is formed unitarily with the lower wall 22*a* and defines a substantially rectangular box that projects out in correspondence to the cut-out 30. The receiving portion 31 is composed of two side walls 32 that project perpendicularly down from left and right side edges of the cut-out 30. The side walls 32 extends linearly in the longitudinal direction of the female housing 20 and are symmetrical with respect to a vertical center line. An approximately square pressure-receiving wall 33 connects lower edges of the side walls 32 to each other, and a front wall 34 connect front edges of both side walls 32 and a front edge of the pressure-receiving wall 33 to each other. The side walls 32 and the pressure-receiving wall 33 extend longitudinally from approximately the longitudinal center of the cylindrical fit-in part 22 to a rear end of the tubular fit-in part 22. Therefore, rear-ends of both side walls 32 and the pressure-receiving wall 33 are flush and continuous with the coupling 28 at the rear end of the tubular fit-in part 22. An opening 35 penetrates through the coupling 28 for receiving a retainer 40. The opening 35 is in a widthwise portion of the coupling 28 corresponding to the cut-out 30. A temporary locking receiving projection 36 and a main locking receiving projection 37 are formed at longitudinally spaced positions on outer side surfaces of both left and right side walls 32.

Two elastic hold-down pieces 38 are formed unitarily with the lower wall 22*a* and cantilever rearward from a front edge of the cut-out 30 of the lower wall 22*a*. The elastic hold-down pieces 38 are widthwise symmetrical with respect to a vertical center line. A rear extended end of each elastic hold-down piece 38 is positioned at approximately the longitudinal center of the cut-out 30. Additionally, the elastic hold-down piece 38 substantially corresponds longitudinally to the position of the seal ring 26. A hold-down projection 39 is formed at the rear end of each elastic hold-down piece 38 and has an upper surface projecting towards the terminal fitting accommodation part 21. An upper surface of a region of the elastic hold-down piece 38 forward from the hold-down projection 39 is flush with the lower wall 22*a* of the tubular fit-in part 22, and an upper surface of the hold-down projection 39 is upward from an inner surface of the lower wall 22*a*. The elastic hold-down piece 38 is flexible vertically towards and away from the terminal fitting accommodation part 21. In free state in which the elastic hold-down piece 38 and the seal ring 26 are not elastically deformed, the interval between the hold-down projection 39 and the seal ring 26 is smaller than the thickness of the hood 12.

The retainer 40 is molded unitarily from a synthetic resin and has a substantially rectangular rear wall 43. A substantially square hold-down plate 41 and two arms 42 project substantially perpendicularly forward from the rear wall 44. The arms 42 are spaced out from opposite left and right side edges of the hold-down plate 41 and are aligned substantially normal to the hold-down plate 41. A lock 44 is formed on the inner side surface of each arm 42. The arms 42 are flexible towards and away from the hold-down plate 41. The retainer 40 can be held selectively at a temporary locking position (FIG. 2) where the hold-down plate 41 penetrates slightly into the receiving portion 31 and a main locking position (FIG. 1) forward from the temporary locking position where the hold-down plate 41 penetrates deeply into the receiving portion 31. The locks 44 are locked between the temporary lock receiving projection 36 and the main lock receiving projection 37 when the retainer 40 is at the temporary locking position to prevent the retainer 40 from moving longitudinally. At the main locking position, the rear wall 43 contacts the rear end of the side wall 32 from the rear, and the locks 44 are locked to the main lock receiving projection 37 from the front to prevent the retainer from moving longitudinally.

Figure 4:
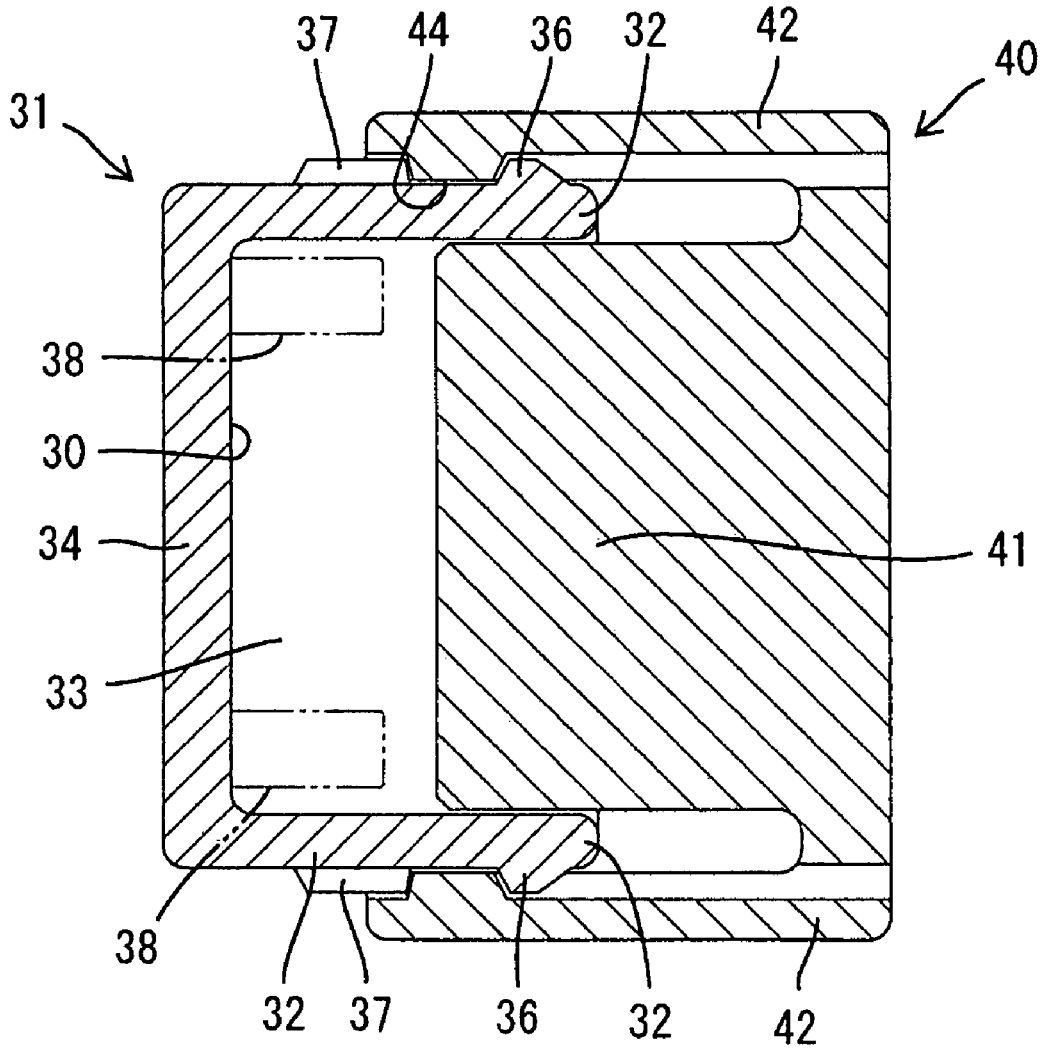
FIG. 4 is a sectional view along a line Y-Y of FIG. 2.
Figure 5:
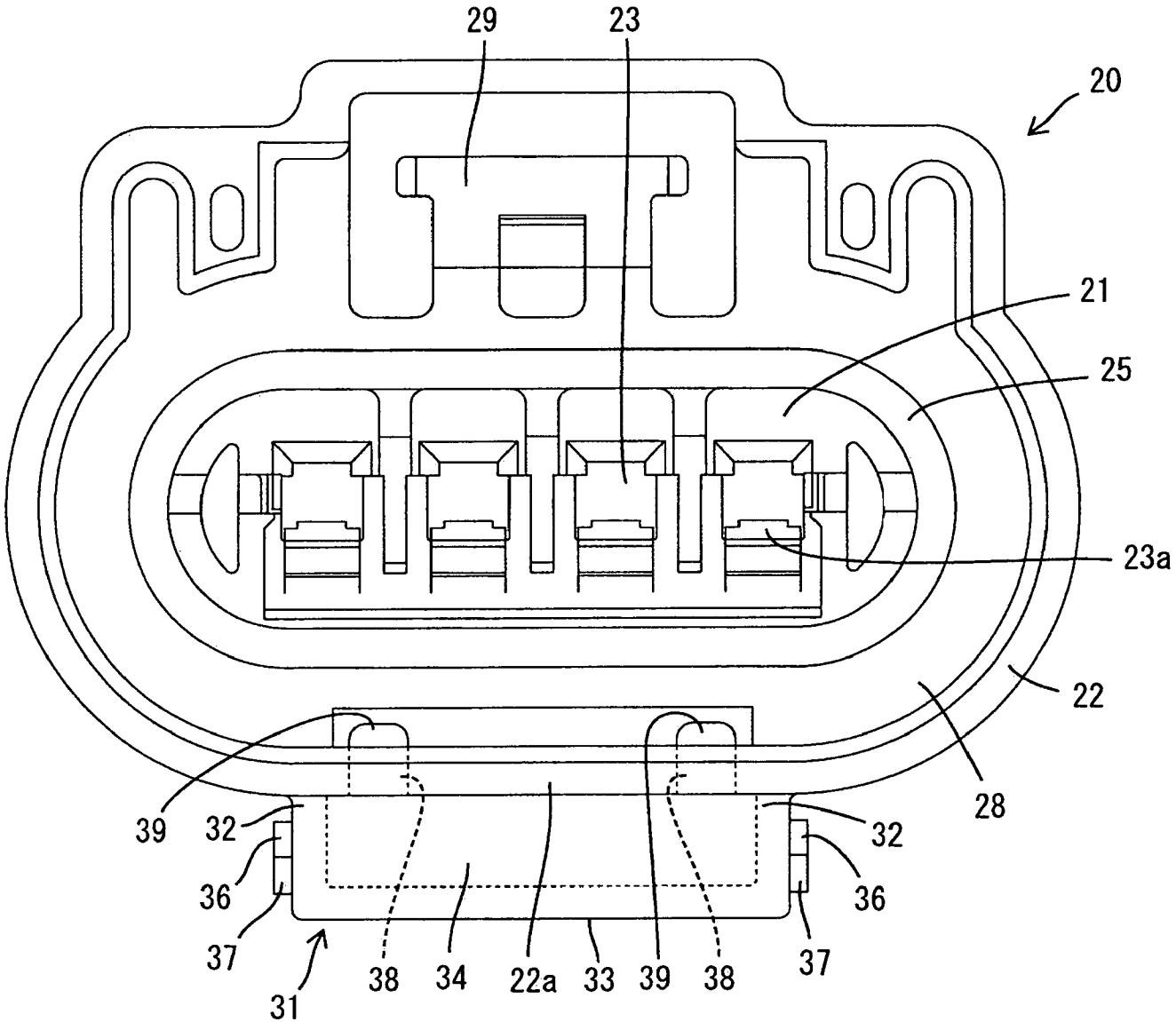
FIG. 5 is a front view of the female housing.
Figure 6:
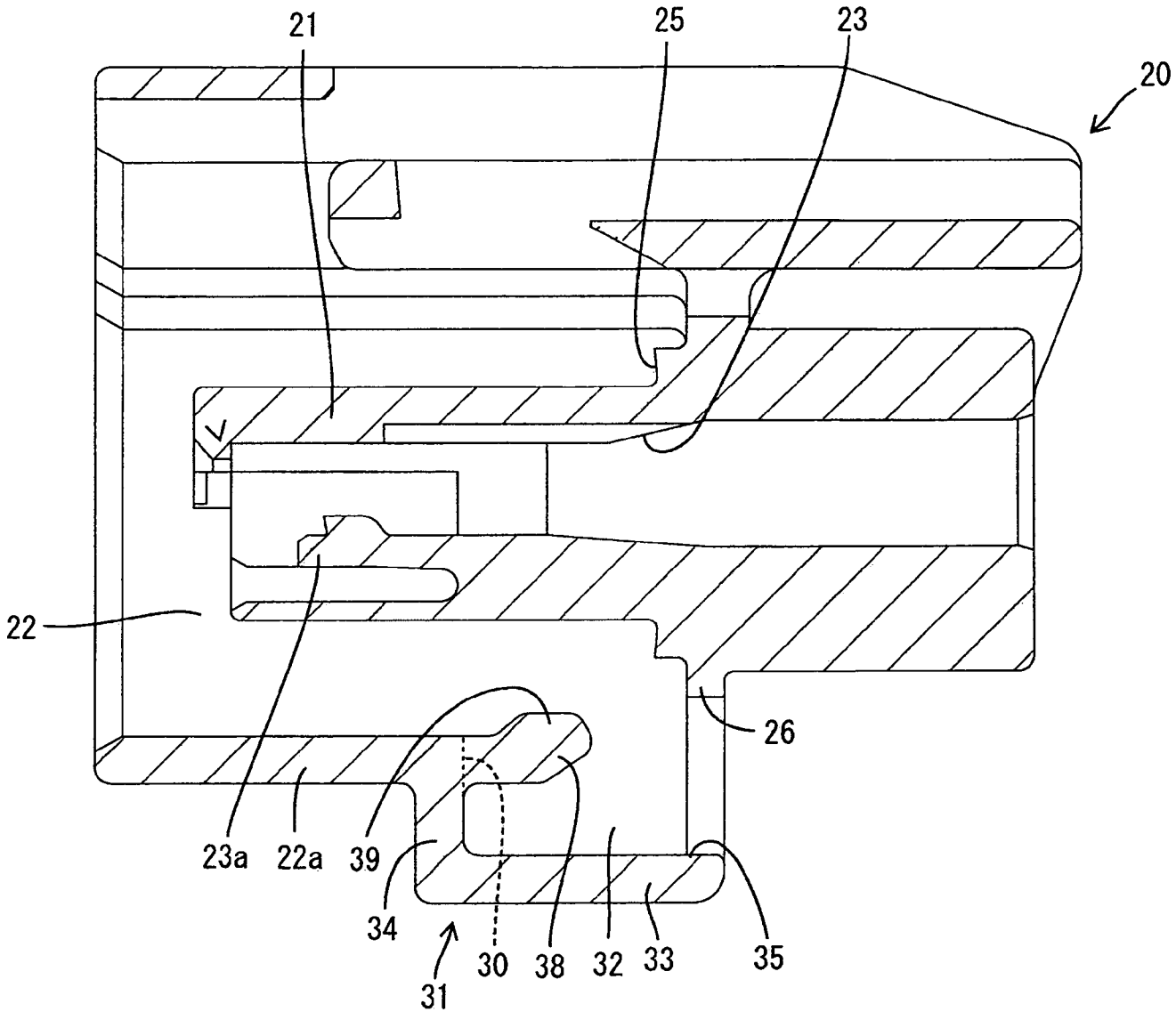
FIG. 6 is a sectional view of the female housing.
Figure 7:
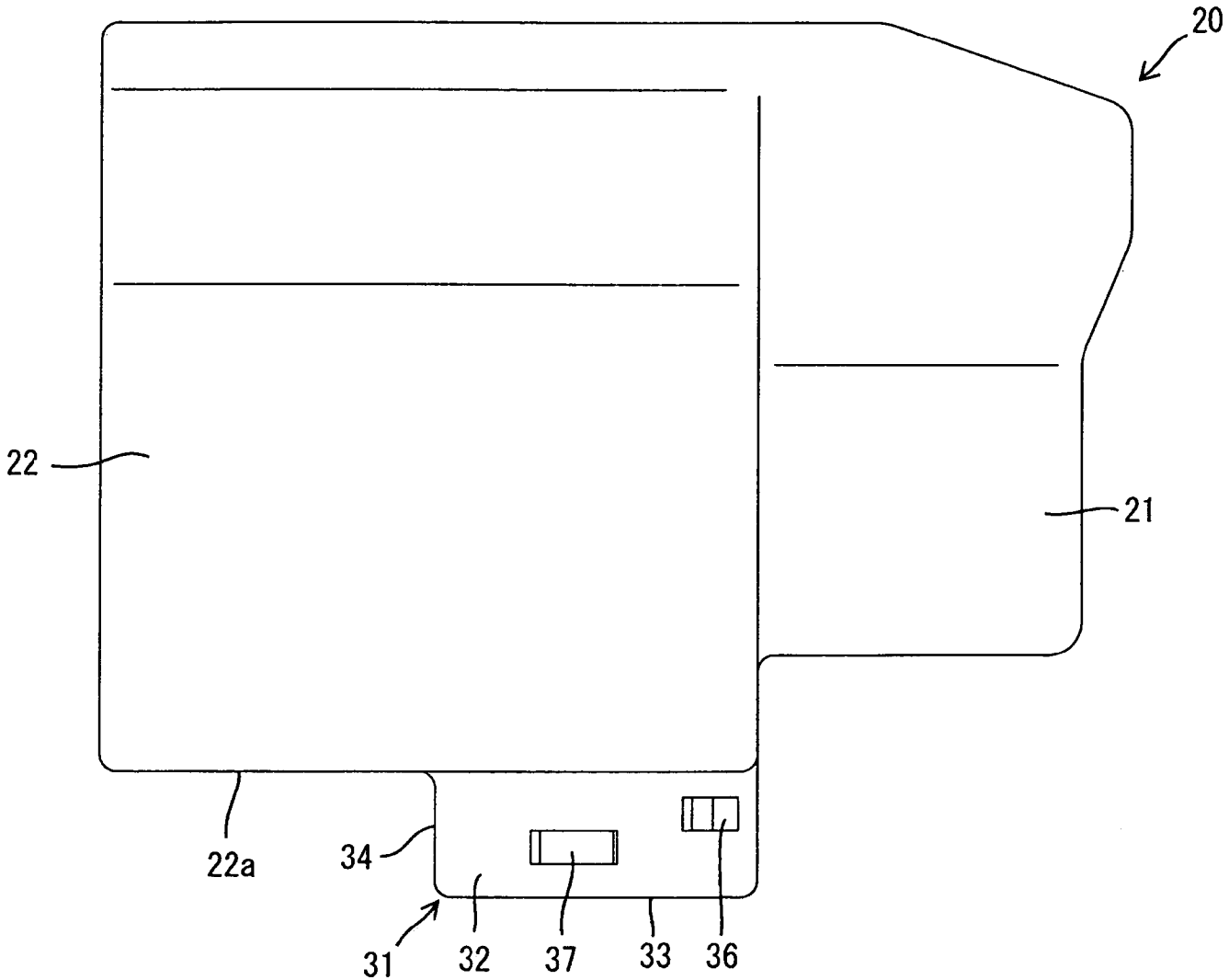
FIG. 7 is a side view of the female housing.
Figure 8:
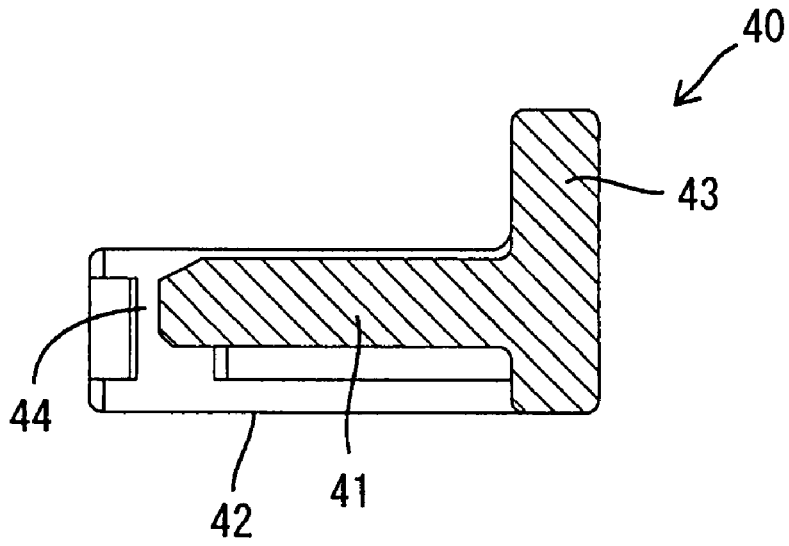
FIG. 8 is a sectional view of a retainer.
Figure 9:
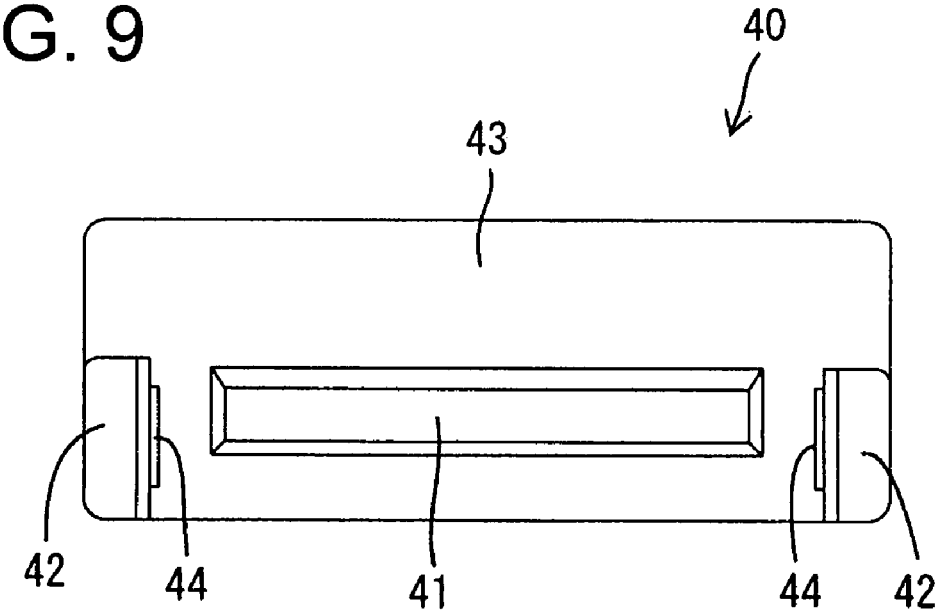
FIG. 9 is a front view of the retainer.

The retainer 40 is mounted on the receiving portion 31 of the female housing 20 and is held at the temporary locking position (see FIGS. 2 and 4) prior to fitting the male and female housings 10 and 20 together. In this state, the hold-down plate 41 is rearward from the elastic hold-down piece 38 and does not contact the elastic hold-down piece 38. Thus, the hold-down part 41 does not flex the elastic hold-down piece 38.

The terminal fitting accommodation part 21 of the female housing 20 then is fit into the hood 12 of the male housing 10. In this step, the locking arm 29 rides over the locking projection 14 and elastically flexes like a seesaw. The front edge of the hood 12 contacts the hold-down projection 39 and elastically flexes the elastic hold-down piece 38 down when both housings 10 and 20 approach a normal fit-in position. At this time, the inner peripheral surface of the hood 12 contacts the periphery of the seal ring 26. Thus, the seal ring 26 is deformed elastically and squeezed between the inner peripheral surface of the hood 12 and the periphery of the terminal fitting accommodation part 21. The locking arm 29 passes the locking projection 14 and elastically returns to its original state when both housings 10 and 20 reach a normal fit-in state. Accordingly, the locking arm 29 locks to the locking projection 14, and both housings 10 and 20 are locked in the normal fit-in state. The contact between the hold-down projection 39 and the hood 12 keeps the elastic hold-down piece 38 flexed elastically and the inner periphery of the hood 12 elastically deforms the seal ring 26 until both housings 10 and 20 are fit normally. The hold-down projection 39 and the hood 12 are in a point contact in a side view.

In the normal fit-in state, the seal ring 26 displays a sealing function to prevent water from penetrating into the gap between the terminal fitting accommodation part 21 and the hood 12. Additionally, the tab 13*a* advances into the male terminal fitting 13, and is connected conductively thereto.

The elastic hold-down piece 38 is formed unitarily with the tubular fit-in part 22 and imparts to the periphery of the hood 12 an elastic pressing force approximately perpendicular to fit-in direction of both housings 10 and 20 when the housings 10 and 20 have been fit normally. The elastic pressing force prevents transverse movement between the tubular fit-in part 22 and the hood 12 and also prevents shaking between the male and female housings 10 and 20 in directions approximately perpendicular to fit-in direction of the housings 10 and 20. Thus, defective contact between the female and male terminal fittings 24 and 13 can be prevented.

The retainer 40 is pressed forward from the temporary locking position to the main locking position after both housings 10 and 20 are fit normally together. The elastic hold-down piece 38 is flexed down by the hood 12 in the step of pressing the retainer 40 to the main locking position, and the hold-down part 41 is inserted between the elastic hold-down piece 38 and the pressure-receiving wall 33 like a wedge. As a result, the elastic hold-down piece 38 is pressed a little upward to enhance the pressing force of the elastic hold-down piece 38 against the hood 12. Thus, it is possible to prevent the male housing 10 and the female housing 20 from shaking in the radial direction. The upper surface of the hold-down part 41 and the lower surface of the elastic hold-down piece 38 have a surface contact.

The elastic pressing force of the elastic hold-down piece 38 prevents the housings 10 and 20 from shaking in directions that are perpendicular or approximately perpendicular to the fit-in direction when the housings 10 and 20 have been fit together. The elastic hold-down piece 38 is made of synthetic resin and has an elastic deformation amount smaller than an elastic hold-down piece made of rubber. Thus, the synthetic resin elastic hold-down piece 38 is more effective than the elastic hold-down piece made of rubber at preventing the housings 10 and 20 from shaking.

The retainer 40 is fit on the female housing 20 and prevents the elastic hold-down piece 38 from displacing away from the hood 12 of the male housing 10. Thus the elastic hold-down piece 38 securely displays its hold-down function.

The seal ring 26 made of rubber is provided between peripheral surfaces of the male housing 10 and the female housing 20 when both housings 10 and 20 have been fit together. Additionally, the elastic hold-down piece 38 and the seal ring 26 confront each other in the longitudinal direction of both housings 10 and 20 and the hood 12 is sandwiched radially between the elastic hold-down piece 38 and the seal ring 26. The rubber seal ring 26 is more elastically deformable than the elastic hold-down piece 38 made of the synthetic resin. Thus, the elastic pressing force imparted from the elastic hold-down piece 38 to the hood 12 also is imparted to the seal ring 26 through the hood 12. Accordingly, the crush amount of the seal ring 26 is increased, which improves the sealing function of the crushed portion.

The hood part 12 contacts the seal ring 26 and the hold-down projection 39 of the elastic hold-down piece 38 immediately before the fit-in between the female housing 20 and the male housing 10 is completed. Thus at the step at which both housings 10 and 20 are fit together before the fit-in between the female housing 20 and the male housing 10 is completed, a resistance to the fit-in between the female housing 20 and the male housing 10 caused by the elastic restoring force of the seal ring 26 is not generated. A resistance to the fit-in between the female housing 20 and the male housing 10 caused by the elastic restoring force of the elastic hold-down piece 38 is not generated either. Therefore both housings 10 and 20 can be fit together with a high workability.

The two elastic hold-down pieces 38 are disposed horizontally side by side along the flat plate-shaped lower wall 22*a* of the tubular fit-in part 22. Further the pressure-receiving wall 33 for receiving a reaction force imparted to the retainer 40 from the elastic hold-down piece 38 is also flat plate-shaped. Thus the hold-down part 41 of the retainer 40 also can be flat plate-shaped. That is, the configuration of the retainer 40 can be simplified as compared with a retainer, the hold-down part of which is curved or bent.

The invention is not limited to the embodiment described above with reference to the drawings. For example, the following embodiments are included in the technical scope of the present invention.

The elastic hold-down piece can be formed on only the hood of the male housing or on both the hood and the female housing.

The elastic hold-down piece does not have to be cantilevered, and both ends thereof may be supported by the housing.

The invention is also applicable to a connector with no retainer.

In the present invention, the number of the elastic hold-down pieces may be one or not less than three.

The retainer need not be a dedicated part, and can be formed on an electric wire cover.

What is claimed is:

1. A connector comprising:

a first housing having a front end and a hood open at the front end;

a second housing having a terminal fitting accommodation part with opposite front and rear end, the front ends of the terminal fitting accommodation part being configured to be telescoped into the open front end of the hood of the first housing along a connecting direction, a wall spaced outwardly from the terminal fitting accommodation part sufficiently for moving along an outer surface of the hood when the terminal fitting accommodation part is telescoped into the hood;

at least one elastic hold-down piece formed unitarily on the second housing and cantilevered rearwardly from the wall of the second housing, the elastic hold-down piece being configured for elastically contacting the outer surface of the hood of the first housing at an angle to the connecting direction for substantially preventing shaking between the first and second housings in directions transverse to the connecting direction; and a retainer engageable with the second housing for movement between a first position where the retainer is spaced from the elastic hold-down piece and a second position where the retainer urges the elastic hold-down piece against the first housing, the retainer being configured for preventing the elastic hold-down piece from being displaced out of engagement with the first housing when the first and second housings are telescoped together.

2. The connector of claim 1, further comprising a seal ring made of rubber mounted between peripheral surfaces of said first and second housings when the housings are telescoped together, the elastic hold-down piece being located so that a portion of the first housing is sandwiched between said elastic hold-down piece and said seal ring.

3. The connector of claim 1, wherein the first and second housings are formed from synthetic resin.

4. The connector of claim 3, wherein the elastic hold-down piece is unitary with the second housing.

5. A connector comprising:

a female housing formed from a synthetic resin and having opposite front and rear ends, the female housing further having a terminal accommodating portion and a tubular fit-in part supported outwardly from the terminal accommodating portion;

a male housing formed from a synthetic resin and having a hood configured to be telescoped between the terminal accommodating portion and the tubular fit-in part from the front end of the female housing;

a seal ring made of rubber mounted on the terminal accommodating portion for sealed engagement with the hood of the male housing;

at least one elastic hold-down piece formed unitarily on the female housing, the elastic hold-down piece being cantilevered rearwardly on the tubular fit-in part and configured for elastically urging the hood of the first housing at an angle to the connecting direction and into tight sealing engagement with the seal ring for substantially preventing transverse shaking between the housings; and a retainer engageable with the female housing and configured for preventing the elastic hold-down piece from being displaced out of engagement with the hood of the male housing when the housings are telescoped together.

6. The connector of claim 5, wherein the retainer is engageable with the female housing for movement between a first position where the retainer is spaced from the elastic hold-down piece and a second position where the retainer urges the elastic hold-down piece against the hood of the male housing.

* * * * *